US007326153B2

(12) United States Patent
Bond

(10) Patent No.: US 7,326,153 B2
(45) Date of Patent: Feb. 5, 2008

(54) EXERCISE DEVICE

(76) Inventor: David W. Bond, 4267 Beverly Glen, Sherman Oaks, CA (US) 91423

( * ) Notice: Subject to any disclaimer, the term of this patent is extended or adjusted under 35 U.S.C. 154(b) by 410 days.

(21) Appl. No.: 10/982,569

(22) Filed: Nov. 5, 2004

(65) Prior Publication Data

US 2005/0096194 A1 May 5, 2005

Related U.S. Application Data

(60) Provisional application No. 60/517,543, filed on Nov. 5, 2003.

(51) Int. Cl.
*A63B 21/00* (2006.01)
*A63B 26/00* (2006.01)

(52) U.S. Cl. ..... 482/92; 482/141; 482/907

(58) Field of Classification Search ..... 482/121–126, 482/141, 907, 92, 70–71
See application file for complete search history.

(56) References Cited

U.S. PATENT DOCUMENTS

| | | | | | |
|---|---|---|---|---|---|
| 2,262,761 | A | | 11/1941 | Gay | |
| 3,958,803 | A | | 5/1976 | Geisselbrecht | |
| 4,249,727 | A | | 2/1981 | Dehan | |
| 4,431,184 | A | | 2/1984 | Lew et al. | |
| 4,768,778 | A | | 9/1988 | Thomas, Jr. | |
| 4,781,372 | A | * | 11/1988 | McCormack | 482/70 |
| 5,031,906 | A | | 7/1991 | Jang | |
| 5,064,189 | A | | 11/1991 | Shiuh-Shinn | |
| 5,205,802 | A | * | 4/1993 | Swisher | 482/141 |
| 5,226,868 | A | | 7/1993 | Montgomery | |
| 5,269,737 | A | * | 12/1993 | Sobotka | 482/123 |
| 5,358,463 | A | | 10/1994 | Fuentes | |
| 5,403,253 | A | | 4/1995 | Gaylord | |
| 5,520,598 | A | * | 5/1996 | Little | 482/79 |
| 5,836,858 | A | | 11/1998 | Sharff | |
| 5,971,895 | A | | 10/1999 | Habing | |
| 6,010,439 | A | | 1/2000 | Bullard, Jr. | |
| 6,368,254 | B1 | * | 4/2002 | Wall | 482/71 |
| 6,409,640 | B2 | * | 6/2002 | Cournoyer | 482/141 |
| 6,733,426 | B2 | * | 5/2004 | Bussell | 482/112 |
| 7,022,054 | B2 | * | 4/2006 | Contreras | 482/131 |
| 7,134,987 | B2 | * | 11/2006 | Goldstein | 482/141 |
| 2002/0187883 | A1 | | 12/2002 | Lovison | |

* cited by examiner

*Primary Examiner*—Fenn C. Mathew
(74) *Attorney, Agent, or Firm*—Advantia Law Group; Michael W. Starkweathe; Jason P. Webb

(57) ABSTRACT

A device to exercise a user. The device includes a support member and a plurality of arms. The support member has a major vertical portion. There is a base on bottom of the support member, a pad on top of the support member, a central attachment portion between the base and the pad including a plurality of circumferential attachment locations. The arms each extend substantially radially from the central attachment portion and engage to one of the plurality of circumferential attachment locations. The arms have a longitudinal track along each arm, coupling to an engaged traveling member configured to engage a user's hand, allowing motion of the engaged traveling member only along a defined length. There is a floor buffer member to protect the floor.

16 Claims, 7 Drawing Sheets

EXERCISE DEVICE

CROSS REFERENCE TO RELATED APPLICATIONS

This application claims the benefit of U.S. patent application Ser. No. 60/517,543, entitled "AN EXERCISE DEVICE FOR A USER" to W. David Bond, and filed on Nov. 5, 2003.

BACKGROUND OF THE INVENTION

1. Field of the Invention

The present invention relates generally to the field of physical exercise equipment, specifically an exercise device for a user.

2. Description of the Related Art

The bench press has long been used as the key manner in developing the muscles found in the upper body. When exercising, the conventional bench press bar, which is straight, only allows the hands to go the chest depth level when the bar is lowered its fullest extent for the upward push. It does not allow a full stretch and extension of the chest muscles. Moreover, it is not well adapted for use by athletes seeking maximum muscular development through exercise to the point of exhaustion. The bench press, with the use of other free weights, allows the user to gain superior results.

At the same time, exercising with free weights include a number of hazards and disadvantages. Free weights are large and bulky, requiring significant storage space. Additionally, free weights are heavy, making them likely to cause injury to a user, likely to be dangerous to children, and likely to damage walls, floors, furniture, and other furnishings.

These problems are further compounded where a significant number of weight lifters experience serious injuries incurred while exercising. Such result from the generally unstable nature of a raised weighted bar with its inherently high center of gravity that conventional barbell and dumbbell exercising positions require. The fall or collapse of the bar upon an individual because of tendon or ligament tears, or muscle failure while exercising to complete muscle fatigue has caused serious injuries and in a few instances, death.

Moreover, a bench press and full set of free weights are expensive, as are many other exercise devices which seem to be intended to replace or supplement a bench press and full set of free weights. As well, devices intended to replace or supplement a bench press and full set of free weights are typically complicated and prone to malfunction or breakage. Additionally, these devices often fail to incorporate an appropriate level of muscle stretching and extension into use of the device. Further, these devices are often only suitably situated inside an exercise facility. Still further, these devices sometimes fail to provide adequate configurability for different users, for different exercise routines and/or for exercising different muscle groups.

What is needed is an exercise device that incorporates full muscle stretching and extension that allows a user to exercise to the point of exhaustion with enhanced safety, that is lightweight, that is compact, simple to understand and use, configurable, sturdy and capable of being situated in small rooms, such as bedrooms and offices. It is an object of the invention to provide many or all of the above needs.

SUMMARY OF THE INVENTION

The present invention has been developed in response to the present state of the art, and in particular, in response to the problems and needs in the art that have not yet been fully solved by currently available exercise devices. Accordingly, the present invention has been developed to provide a device to exercise a user that overcomes many or all of the above-discussed shortcomings in the art.

A device to exercise a user is presented in one embodiment. The device may include a support member and a plurality of arms extending therefrom.

In one embodiment the support member may have a top end, a bottom end and a major portion vertically oriented, further the device may include a base attached to the bottom end of the support member and configured to stably support the support member and to restrict substantial horizontal displacement, a pad positioned on the top end of the support member wherein the pad is substantially planar to a chest of the user when the device is in an operative position and wherein the pad is configured to moderate adverse interactions between the top end of the support member and the user, central attachment portion positioned around the support member and between the base and the pad, wherein the central attachment portion includes a plurality of circumferential attachment locations.

The plurality of arms presented in one embodiment each may extend substantially radially from the central attachment portion and each may have a first end, a second end and a top side, each further may include a coupling portion positioned on the first end and configured to engage one of the plurality of circumferential attachment locations, a longitudinal track positioned on the arm, extending substantially radially from the central attachment portion, configured to couple to an engaged traveling member, configured to allow motion of the engaged traveling member along a length of the longitudinal track and configured to restrict motion of the engaged traveling member substantially perpendicular to the longitudinal track, wherein the engaged traveling member is configured to engage a hand of the user, and a floor buffer member attached at the second end of the arm and between the second end of the arm and a floor when the device is in the operative position and configured to moderate adverse interactions between the second end of the arm and the floor.

The device, in another embodiment may include, wherein the support member is configured to selectably adjust the vertical displacement of the pad.

The device, in yet another embodiment may include, wherein the support member is configured to selectably adjust the vertical displacement of the central attachment portion.

The device, in a further embodiment may include, wherein the plurality of arms are each bow-shaped.

The device, in a still further embodiment may include, further comprising a support rod attached to an underside of each of the plurality of arms and configured to restrict substantial flexing of the arms during use.

Further, an embodiment may include, further comprising a slide stop attached to each of the plurality of arms and configured to define an allowed length of the longitudinal track wherein the slide stop restricts motion of the engaged traveling member outside of the allowed length.

Still further, another embodiment may include, wherein the major portion of the support member is a rod.

Again further, one embodiment may include, further comprising a travel resistor attached to the device and configured to resist motion of the engaged traveling member along the length of the longitudinal track during use.

The device, in yet another embodiment may include, further comprising a plurality of slide stop attachment ports positioned on each of the plurality of arms, wherein the plurality of slide stop attachment ports are configured to releasably attach a slide stop at locations configured to define an array of allowed lengths.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
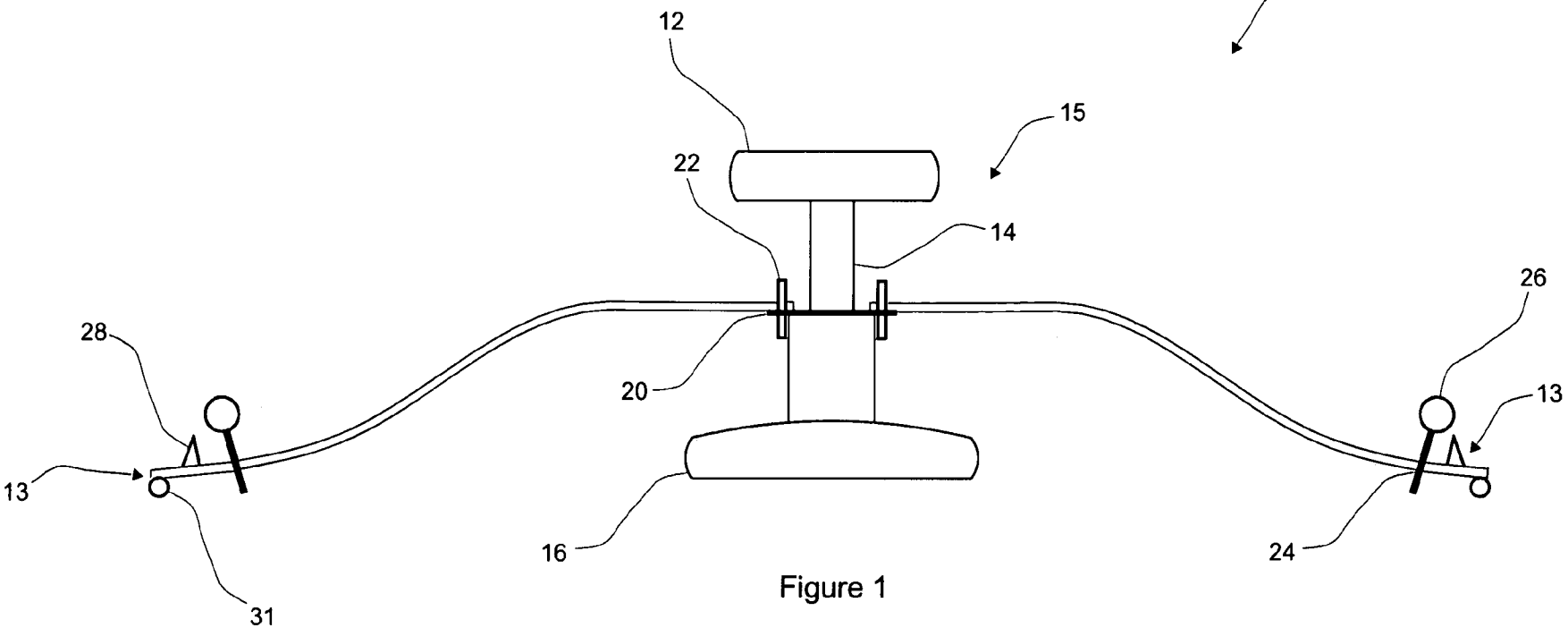
FIG. 1 illustrates a front view of an exercise device according to one embodiment.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment.

FIG. 1 illustrates a front view of an exercise device according to one embodiment. Specifically, the exercise device 10 includes a body, or support member, 15 having a chest pad, or pad, 12 positioned on one end of a vertically adjustable rod, or major portion, 14, a base 16 physically coupled to another end, or bottom end, of the vertically adjustable rod 14 and a connecting mechanism, or circumferential attachment location, 22 that selectably connects the bow shaped arms, or arms, 18 to a central adjustment wheel, or central attachment portion, 20 at a first end of the arms; a sliding device, or engaged traveling member, 26 positioned upon each bow shaped arm 18; a hand grip 26 fixed upon the sliding device 24; slide stops 28 fixed on the bow shaped arms 18 and floor pads, or floor buffers, 31 attached to each bottom of the outside end, or second end, of each bow shaped arm 18. The floor pads 31 protect a floor (not shown) at the likely interface between the floor (not shown) and the bow shaped arms 18.

In operation, the bow shaped arms 18 act as a track, or guide, for the sliding device 24. Slide stops 28 prevent the sliding device 24 from disconnecting from the bow shaped arms 18. The vertically adjustable rod 14 allows a user (not shown) to rest in a lowered position with a users chest (not shown) resting on the chest pad 12. The base 16 supports the vertically adjustable rod 14. The vertically adjustable rod 14 is designed to increase or decrease the height of the chest pad 12 by known screwing, hydraulic, threading or other means known to one skilled in the relevant art.

Figure 2:
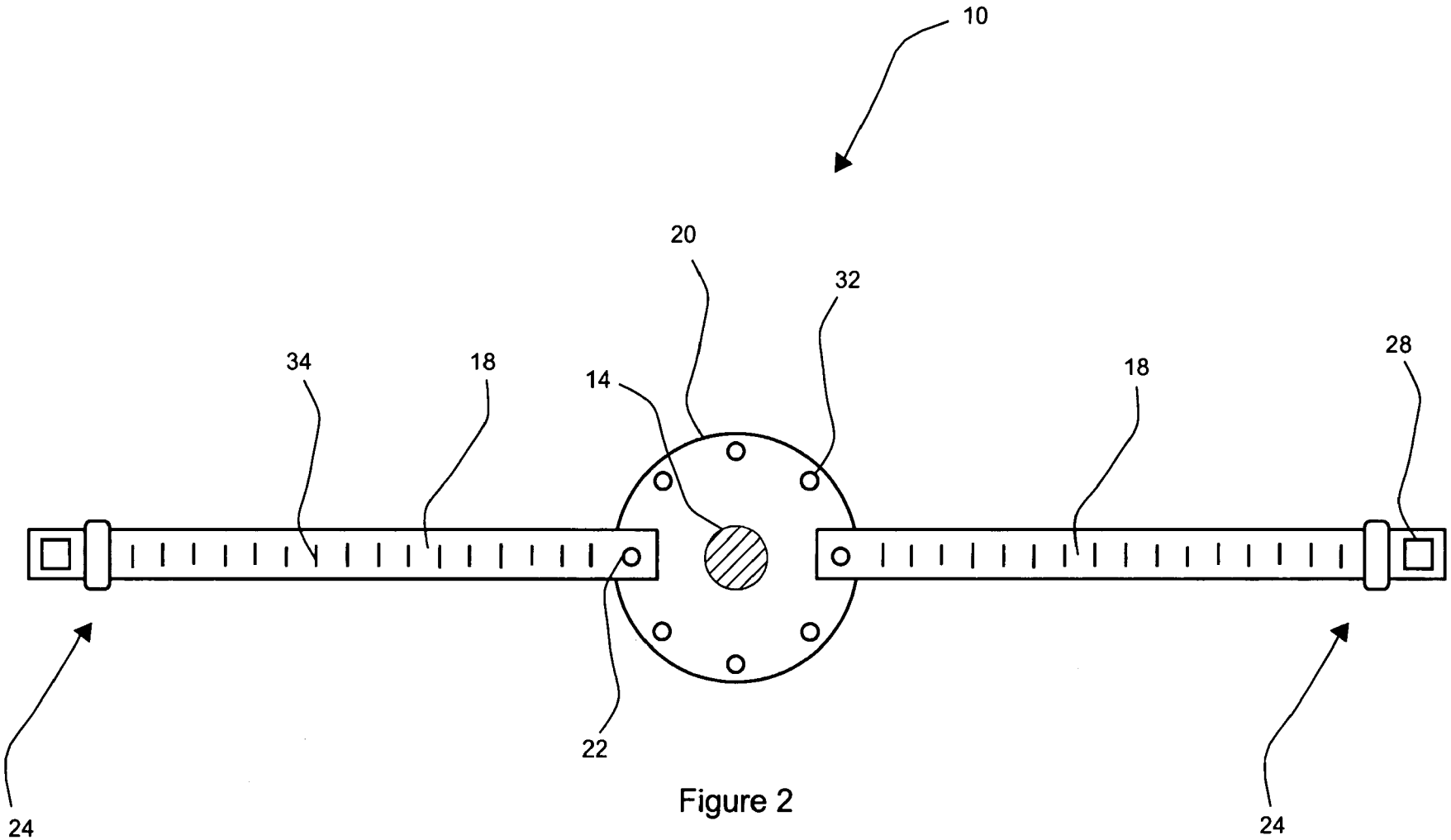
FIG. 2 illustrates a partial sectional top view of an exercise device according to one embodiment.

FIG. 2 illustrates a partial sectional top view of an exercise device according to one embodiment. In particular, the exercise device 10 has bow shaped arms 18 with the sliding devices 24 attached to the central adjustment wheel 20. The central adjustment wheel 20 includes several guide holes, or circumferential attachment locations, 32. A clamping mechanism, or coupling portion, 22 attaches to guide holes 32. One of a plurality of brake slots, or slide stop attachment ports, 34 attaches a slide stop 28 to one of the bow shaped arms 18. The several guide holes 32 allow for adjustability of the angular position of the bow shaped arms 18 in relation to each other. The slide stops 28 are configured to terminate the motion of the sliding device 24 and define the range of motion for the user (not shown).

Figure 3:
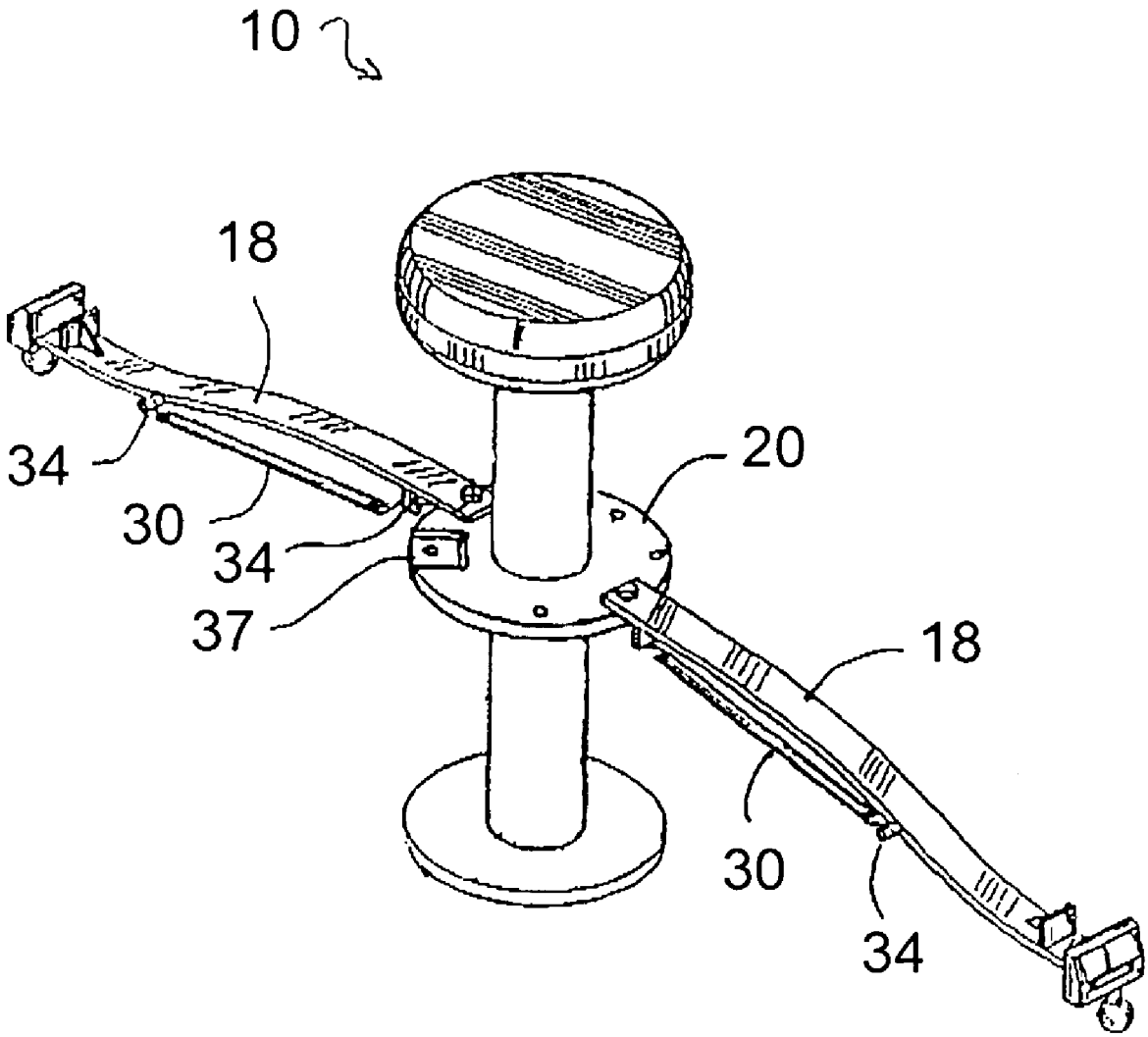
FIG. 3 illustrates a perspective view of an exercise device including a support according to one embodiment.

FIG. 3 illustrates a perspective view of an exercise device including an attached support according to one embodiment. Specifically, there is illustrated a support, or support rod, 30 that further strengthens the bow shaped arms 18 to ensure that there is no bounce, or flexing of the arms 18 during use. The support 30 is rigidly attached to the bow shaped arms 18 by support connectors 34 positioned at either end of the support 30. Additionally, there is illustrated an optional recessed region 37 that stabilizes the bow shaped arms 18 when attached to the central adjustment wheel 20 to control pivot or rotational motion of the bow shaped arms 18 relative to the central adjustment wheel 20.

Figure 4A:
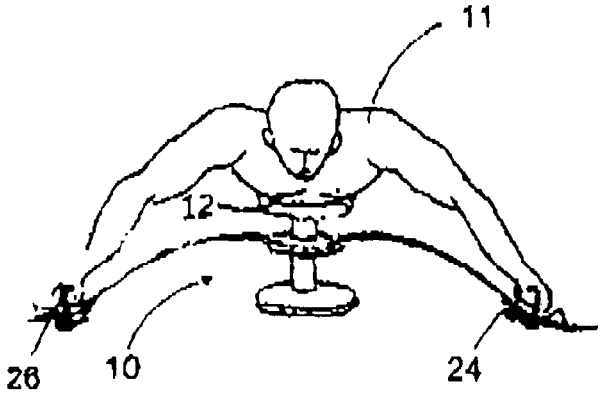
FIGS. 4*a*-4*c* illustrate front and top views of an exercise device according to one embodiment showing a user.
Figure 4B:
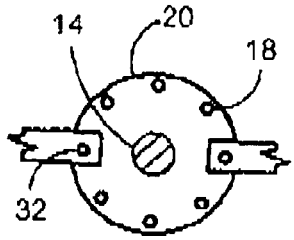
Figure 4C:
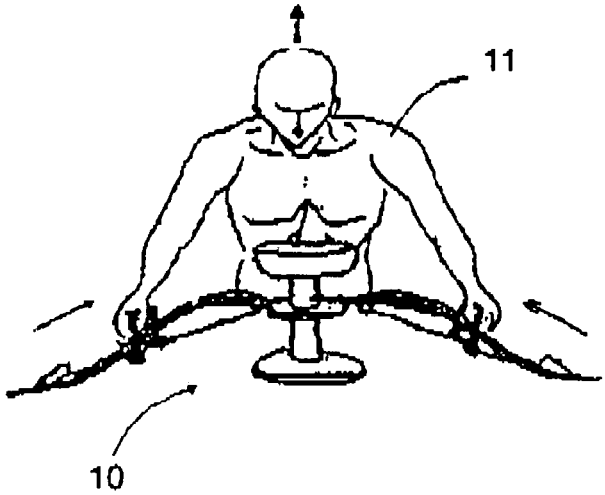

FIGS. 4*a*, 4*b* and 4*c* illustrate front and top views of one embodiment showing a user. FIG. 4*a* illustrates a starting position with the user 11 resting their chest on the chest pad 12 and their arms oriented substantially perpendicular to the body of the user and extended to the maximum reach, and their hands grasping the hand grips 26. FIG. 4*b* is a top view of the central adjustment wheel 20 illustrating the positions of the bow shaped arms 18 as being in opposite locations when attached to the central adjustment wheel 20. FIG. 4*c* illustrates the user 11 in an upward position that is achieved by moving the arms inward toward the user 11.

Figure 5A:
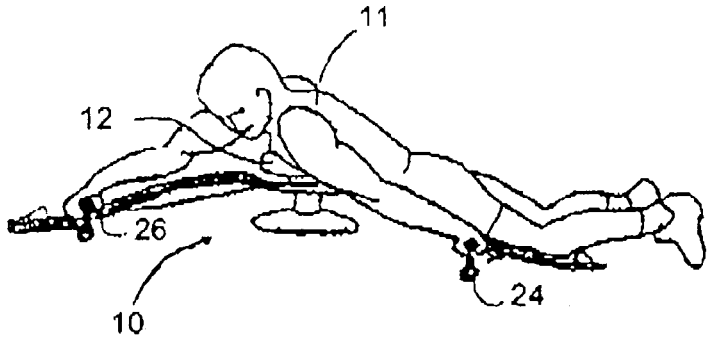
FIGS. 5*a*-5*c* illustrate front and top views of an exercise device according to one embodiment showing a user.
Figure 5B:
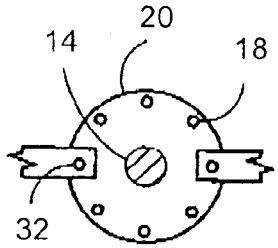
Figure 5C:
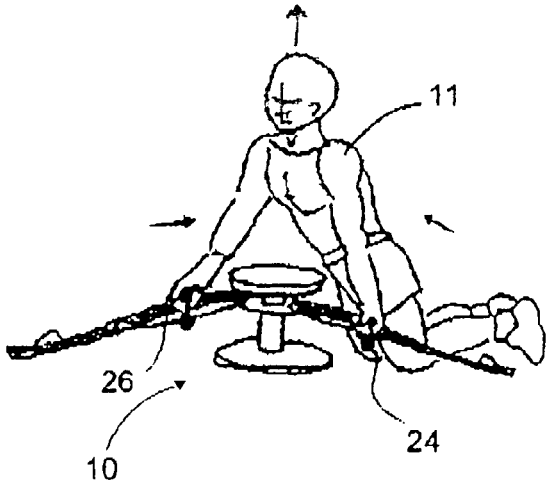

FIGS. 5*a*, 5*b* and 5*c* illustrate views of one embodiment showing a user. FIG. 5*a* illustrates a starting position with the user resting their chest on the chest pad 12 and their arms not substantially perpendicular to the body of the user and extended to the maximum reach, and their hands grasping the hand grips 26 of the sliding devices 24. FIG. 5*b* is a top view of the central adjustment wheel 20 illustrating the positions of the bow shaped arms 18 as being in opposite locations when attached to the wheel 20. FIG. 5*c* illustrates the user 11 in an upward position that is achieved by moving the sliding devices 24 inward toward the user 11.

Figure 6A:
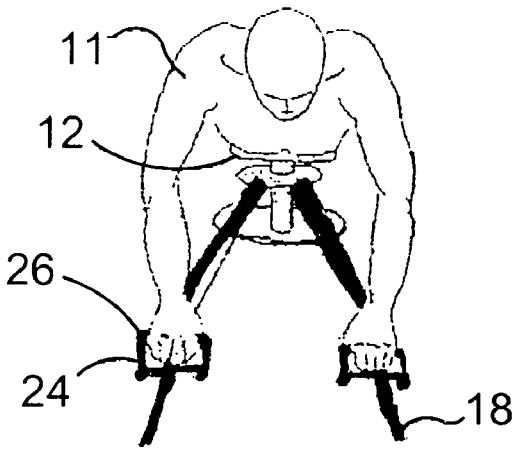
FIGS. 6*a*-6*c* illustrate front and top views of an exercise device according to one embodiment showing a user.
Figure 6B:
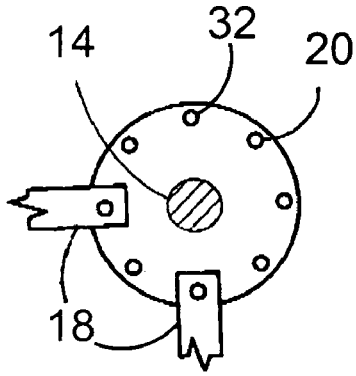
Figure 6C:
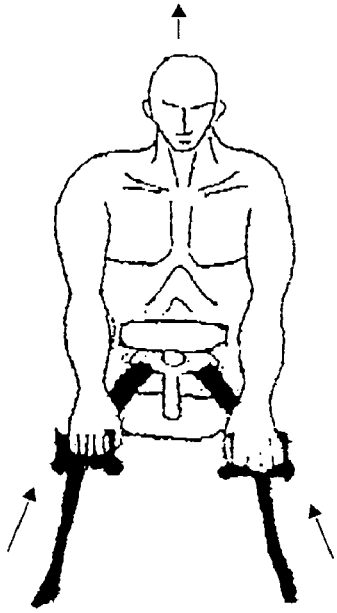

FIGS. 6*a* and 6*b* illustrate views of one embodiment showing a user. FIG. 6*a* illustrates a starting position with the user 11 resting their chest on the chest pad 12 and their arms extended to the maximum reach straight in front of the user 11, and their hands grasping the hand grips 26 of sliding devices 24. In this position, other muscle groups can receive a workout. FIG. 6*b* illustrates the positions of the arms 18 as being in closer proximity when attached to the wheel 20. FIG. 6*c* illustrates the user 11 in an upward position that is achieved by moving the arms inward toward the user 11.

Figure 7A:
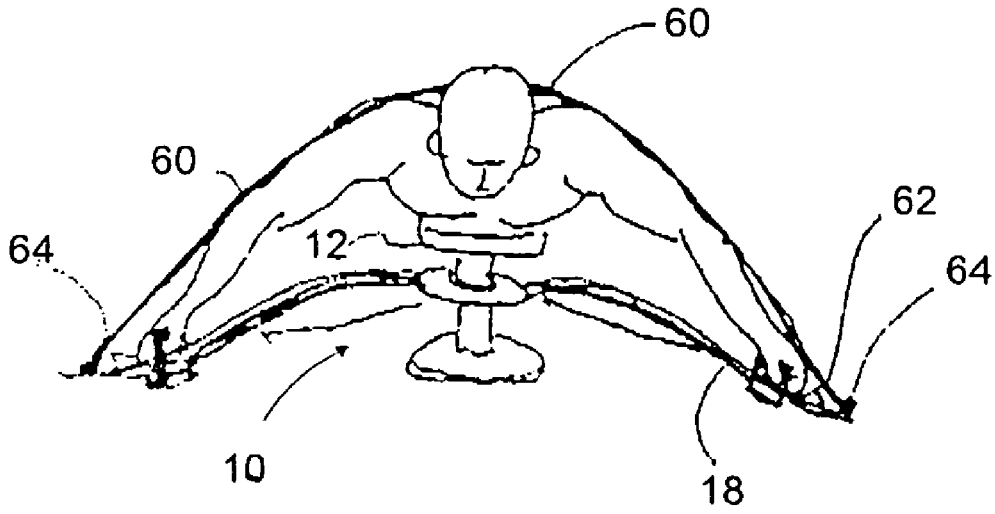
FIGS. 7*a* and 7*b* illustrate views of an exercise device according to one embodiment showing a user and an attached resistor.
Figure 7B:
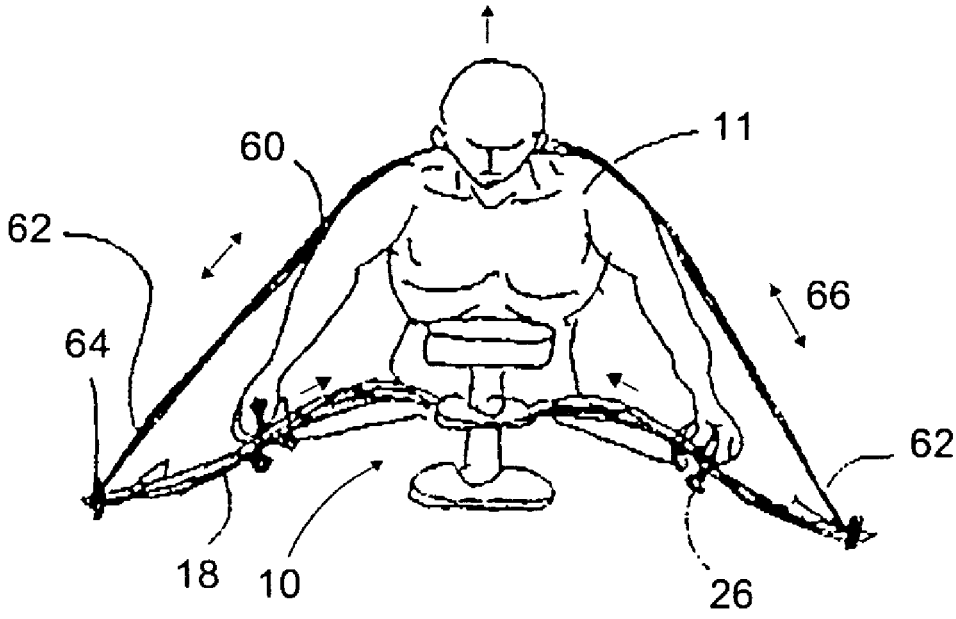

FIGS. 7*a* and 7*b* are views of one embodiment with a user. FIG. 7*a* illustrates a starting position with the user resting their chest on the chest pad 12 and their arms extended to the maximum reach, and their hands grasping the hand grips 26 of the sliding devices 24. Additionally, there is illustrated an optional resistance belt, or travel resistor, 60 that has its opposite ends 62 attached to the ends of the arms 18 with belt attachments 64 at either end of the arms 18. The belt 60 is flexible and resilient to stretch 66 as the user 11 pushes upward against it. This is designed to add extra resistance the exercises illustrated herein. FIG. 7*b* illustrates the user 11 in an upward position that is achieved by moving the arms inward toward the user 11.

It is understood that the above-described preferred embodiments are only illustrative of the application of the principles of the present invention. The present invention may be embodied in other specific forms without departing from its spirit or essential characteristics. The described embodiments are to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, it is noted that there is no particular requirement for a single means of securing the bow shaped arms 18 to the central adjustment wheel 20. As would be apparent to one skilled in the art, a clamp, screw, or snap may be used to attach the bow shaped arms 18 to the central adjustment wheel 20. The material of the bow shape arms 18 may be produced from, but not limited to, steel, plastic, composite, and wood, just so there is relatively little flexibility to the arms 18 as the exercise device 10 is being operated is preferred. The manner in which the sliding device 24 may move up and down the arm may include, but not limited to, wheels and a track to roll in, bearings, a low friction surface, and magnetic repulsion, just so there is appropriate freedom of motion along the track. It is envisioned, any type of sliding device may be used, such as a tube for the arms 18 and a ring positioned around the tube, and any other sliding means for motion. The chest pad 12, stationed upon the vertically adjustable rod, is intended to be raised or lowered by any known means, such as a hydraulic lift, locking pins, screws or threading, etc.

Although it is illustrated that the arms 18 may be moved to different locations on the wheel 20 and attached via holes 32, any other means for attaching the arms 18 around the central post 14 is contemplated. For example, a clamping device may be used at arm ends to attach to the wheel 20. Additionally, the arms may be coupled individually to the support post 14 by means of rings that can rotate around the post 14. The arms 18 may also be locked into a single pivotable position that allows the arms 18 to pivotally lock into different angled positions, similar to a car seat back reclining adjustment mechanism.

Additionally, although the figures illustrate having a circular central adjustment wheel 20, it is contemplated that the adjustment wheel may be any shape which allows sufficient attachment of the bow shaped arms 18. Specifically, the shape of the central adjustment wheel 20 may facilitate proper attachment of the arms 18 for a certain routine, specific workout style, or for accommodation of special needs. In particular, the wheel may provide attachments at various radii and angular displacement about a center of the wheel 20. Further, the wheel 20 may provide attachments at various distances above the floor.

It is also envisioned that the sliding devices 24 may be configured to provide variable and configurable friction, or resistance to motion along the bow shaped arms 18. The sliding devices 24 may also be configured to have negligible friction. Further, the sliding devices may be designed to have substantial friction in one direction but not in another. This may accommodate special needs or provide enhanced or reduced difficulty in one exercise motion or another.

It is envisioned that the exercise device 10 may be embodied in numerous design variations. For example, one embodiment may entail construction from a single piece of material.

It is further envisioned that, the rod 14 and chest pad 12 may be configured to provide spring like support to the chest and body of the user. The base 16 may be further configured to attach to a floor, either permanently or temporarily.

Also, while it is envisioned that a typical embodiment would restrict pivotal motion of the bow shaped arms, one embodiment may entail allowing a certain range of pivotal motion of the bow shaped arms, either about an axis of the connection 22 or about the rod 14, or even some other axis.

While the illustrated embodiments show two separate sliding devices moving independently, it is contemplated that the sliding devices 24 may be configured to move dependently. Further, the handles 26 may be configured to allow a user to lock/unlock the location of the handles 26 along the length of the bow shaped arms 18.

While the drawings illustrate a configurable height of the chest pad 12, the distance from the central adjustment wheel 20 to the base 16 may also be configurable, thus changing the slant of the bow shaped arms 18.

In another embodiment, the device 10 comprises more than two arms 18. Further, it is envisioned that the grips 26 may be configured to engage the feet of a user.

In another embodiment there is no body 15 connecting the arms 18, but instead the arms 18 are in sufficient proximity for a user 11 to simultaneously engage the grips 26 and wherein the arms 18 are configured to be sufficiently stable to allow the user 11 to rest a portion of their weight on the device 10 while moving the sliding devices 24.

In another embodiment, the device 10 is configured to accommodate special needs. While the drawings show significant symmetry in the device, the arms 18 could be of diverse lengths and shapes as well as asymmetric lengths and shapes. The embodiment could include a plurality of sets of arms with diverse lengths and shapes.

It is envisioned that the stops 28 may be springs, wedges, or areas of increased friction between the sliding devices 24 and the bow shaped arms 18, or any other known device used to limit the motion of the sliding devices.

It is further envisioned that the body 15 may include all or only one or more of the components illustrated in the drawings or that one or more of those components may be integrated.

It is further envisioned that the base 16 may or may not be in physical contact with the floor.

It is additionally envisioned that the sliding devices 24 and or the grips 26 may be configured to pivot about an axis substantially perpendicular to the floor while in use for enhanced safety and or comfort to the wrists and hands of the user.

It is still further envisioned that the travel resistor 60 may be an elastic band connecting the sliding devices 24 to any portion of the arms 18 or body 15.

It is envisioned that the lower body of the user may be selectably elevated to change muscles being exercised and or the difficulty of use of the device.

It is also envisioned that the floor buffers 31 may extend along the interface between the device 10 and the floor along the plane of the floor wherein the floor buffers enhance the stability of the device.

Finally, it is envisioned that the components of the device may be constructed of a variety of materials, including but not limited to metal, wood, ceramic, and any other acceptable material.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A device to exercise a user, comprising:

a support member having a top end, a bottom end and a major portion vertically oriented, further including:

a base attached to the bottom end of the support member and configured to stably support the support member and to restrict substantial horizontal displacement;

a pad positioned on the top end of the support member wherein the pad is substantially planar to a chest of the user when the device is in an operative position and wherein the pad is configured to moderate adverse interactions between the top end of the support member and the user;

a central attachment portion positioned around the support member and between the base and the pad, wherein the central attachment portion includes a plurality of circumferential attachment locations; and a plurality of arms each extending substantially radially from the central attachment portion and each having a first end, a second end and a top side, each further including:

a coupling portion positioned on the first end and configured to engage one of the plurality of circumferential attachment locations;

a longitudinal track positioned on the arm, extending substantially radially from the central attachment portion, configured to couple to an engaged traveling member, configured to allow motion of the engaged traveling member along a length of the longitudinal track and configured to restrict motion of the engaged traveling member substantially perpendicular to the longitudinal track, wherein the engaged traveling member is configured to engage a hand of the user; and a floor buffer member attached at the second end of the arm and between the second end of the arm and a floor when the device is in the operative position and configured to moderate adverse interactions between the second end of the arm and the floor.

2. The device of claim 1, wherein the support member is configured to selectably adjust the vertical displacement of the pad.

3. The device of claim 1, wherein the support member is configured to selectably adjust the vertical displacement of the central attachment portion.

4. The device of claim 1, wherein the plurality of arms are each bow-shaped.

5. The device of claim 1, further comprising a support rod attached to an underside of each of the plurality of arms and configured to restrict substantial flexing of the arms during use.

6. The device of claim 1, further comprising a slide stop attached to each of the plurality of arms and configured to define an allowed length of the longitudinal track wherein the slide stop restricts motion of the engaged traveling member outside of the allowed length.

7. The device of claim 1, wherein the major portion of the support member is a rod.

8. The device of claim 1, further comprising a travel resistor attached to the device and configured to resist motion of the engaged traveling member along the length of the longitudinal track during use.

9. The device of claim 6, further comprising a plurality of slide stop attachment ports positioned on each of the plurality of arms, wherein the plurality of slide stop attachment ports are configured to releasably attach a slide stop at locations configured to define an array of allowed lengths.

10. A device for exercising, comprising:

a plurality of arms, each configured to provide an exercise track and each positioned in sufficient proximity one to another to be used simultaneously;

a sliding device for each of the plurality of arms wherein each sliding device is attached to one of the plurality of arms and configured to slide along the provided exercise track;

a grip attached to each sliding device and configured to engage a user;

a wheel having a plurality of attachment ports configured to removably attach an end of each of the plurality of arms, wherein the plurality of arms are removably attached to the wheel;

a base attached to the bottom of the wheel and configured to hold the wheel a certain distance from the floor;

a chest pad attached to the top of the wheel and configured to provide a buffer between a body of the user and the wheel; and a rigid support attached to an arm and configured to prevent the arm from flexing during use.

11. The device of claim 10, further comprising attachment ports on the wheel configured to provide a plurality of arm attachment dispositions, wherein the attachment ports are configured to restrict angular motion of the arms.

12. The device of claim 10, further comprising an adjustable rod attached to the chest pad and the wheel, configured to selectably raise and lower the chest pad with respect to the floor.

13. The device of claim 10, further comprising slide stops attached to the arms and configured to limit motion of the sliding devices along the length of the arms.

14. The device of claim 13, further comprising slide stop attachment ports on the arms configured to removably attach slide stops at various locations along the length of the arms.

15. The device of claim 10, further comprising a motion resistor attached to the arms and configured to resist motion of the sliding devices.

16. A device to exercise a user, comprising:

a rod-shaped support member, having a top end, a bottom end and a major portion vertically oriented, further including:

a base attached to the bottom end of the support member and configured to stably support the support member and to restrict substantial horizontal displacement;

a pad positioned on the top end of the support member wherein the pad is substantially planar to a chest of the user when the device is in an operative position and wherein the pad is configured to moderate adverse interactions between the top end of the support member and the user, wherein the support member is configured to selectably adjust the vertical displacement of the pad;

a central attachment portion positioned around the support member and between the base and the pad, wherein the central attachment portion includes a plurality of circumferential attachment locations, wherein the support member is configured to selectably adjust the vertical displacement of the central attachment portion; and a plurality of bow-shaped arms each extending substantially radially from the central attachment portion and each having a first end, a second end and a top side, each further including:

a coupling portion positioned on the first end and configured to engage one of the plurality of circumferential attachment locations;

a longitudinal track positioned on the arm, extending substantially radially from the central attachment portion, configured to couple to an engaged traveling member, configured to allow motion of the engaged traveling member along a length of the longitudinal track and configured to restrict motion of the engaged traveling member substantially perpendicular to the longitudinal track, wherein the engaged traveling member is configured to engage a hand of the user;

a slide stop attached to each of the plurality of arms and configured to define an allowed length of the longitudinal track wherein the slide stop restricts motion of the engaged traveling member outside of the allowed length;

a travel resistor attached to the device and configured to resist motion of the engaged traveling member along the length of the longitudinal track during use;

a plurality of slide stop attachment ports positioned on each of the plurality of arms, wherein the slide stop attachment ports are configured to releasably attach the slide stops at locations configured to define an array of allowed lengths;

a support rod attached to an underside of each of the plurality of arms and configured to restrict substantial flexing of the arms during use; and a floor buffer member attached at the second end of the arm and between the second end of the arm and a floor when the device is in the operative position and configured to moderate adverse interactions between the second end of the arm and the floor.

* * * * *